United States Patent [19]

Hagemann

[11] 3,964,424

[45] June 22, 1976

[54] INFLUENCE DETECTING GEAR WITH IMPROVED TOWING CHARACTERISTICS

[75] Inventor: Julius Hagemann, Panama City, Fla.

[73] Assignee: The United States of America as represented by the Secretary of the Navy, Washington, D.C.

[22] Filed: Apr. 2, 1958

[21] Appl. No.: 726,019

[52] U.S. Cl. ..... 114/235 B; 340/3 T

[51] Int. Cl.[2] ..... B63B 21/56

[58] Field of Search ..... 114/235, 235.1, 235.2, 114/235.3, 221, 240; 340/3, 4, 5, 6, 9, 13; 324/23, 34, 43

[56] References Cited

UNITED STATES PATENTS

| | | | |
|---|---|---|---|
| 2,419,053 | 4/1947 | Bennett | 114/240 |
| 2,551,417 | 5/1951 | Carlisle | 340/4 |
| 2,627,930 | 2/1953 | Woods | 114/235 |
| 2,652,550 | 9/1953 | Lash | 114/235 |
| 2,668,512 | 2/1954 | Klas | 114/240 |

FOREIGN PATENTS OR APPLICATIONS

| | | | |
|---|---|---|---|
| 606,419 | 8/1948 | United Kingdom | 114/235 |

*Primary Examiner*—Charles T. Jordan
*Attorney, Agent, or Firm*—W. O. Quesenberry; Rolla N. Carter

EXEMPLARY CLAIM

1. A towable detecting gear adapted for dragging over a water-submerged surface comprising a tail portion, a towing cable having its trailing end enclosed in a tail portion and having at least one insulated conductor, a weight member secured to said cable at the forward end of the tail portion and having sufficient negative buoyancy to drag along said submerged surface when under tow, a plurality of detecting devices disposed at intervals along the cable in said tail portion and in electrical communication with a conductor therein, said detecting devices being substantially larger in cross section than the diameter of said cable, a layer of buoyant material surrounding said cable between said devices and having a thickness such that its diameter is at least equal to the diameter of said detecting devices, and an outer covering of wear resistant flexible material enclosing said tail portion.

4 Claims, 2 Drawing Figures

JULIUS HAGEMANN

Figure 1:
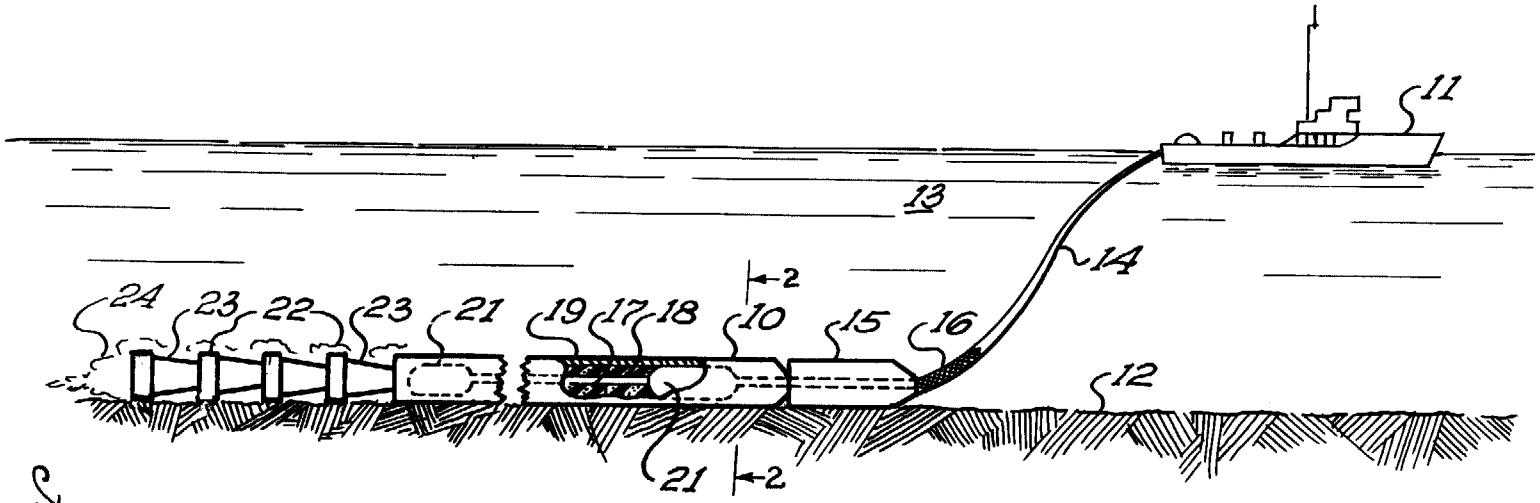

INVENTOR.

BY W. C. Quesenberry
Rolla N. Carter
ATTORNEYS

INFLUENCE DETECTING GEAR WITH IMPROVED TOWING CHARACTERISTICS

The invention described herein may be manufactured and used by or for the Government of the United States of America for govermental purposes without the payment of any royalties thereon or therefor.

The present invention relates to a marine cable for use in detection gear employed for surveying a sea bottom and more particularly to an electrical conductor provided along its terminal portion with detection devices larger in cross section than the diameter of the cable per se.

The primary purpose of the invention is to provide detection gear of the above type having improved towing characteristics as it is dragged along the sea bed.

Heretofore, detection gear devices mounted in spaced relation along the tail portion of a towable cable have been provided with a weight attached to the end of the cable at the rear of the detection devices for keeping the tail on the sea bed while under tow. With this arrangement the casings enclosing the detecting devices, being heavy enough to stay on the bottom while under tow, were subjected to heavy wear; the weight at the end of the tail tended to execute jumps and other abrupt movements when it encountered obstacles on the bottom thereby causing sudden movements of the detecting devices; and, the bulges formed by the detecting devices and the terminal weight were not conducive to a smooth movement along the bottom.

In accordance with the invention the weight for holding down the tail portion of a towable conductor cable is secured to the cable immediately in front of the tail portion containing the detecting devices and this tail portion is given a uniform diameter throughout its length by building up the cable sections between the detecting devices to at least the diameter of the said devices. The material employed for this building up of the cable diameter is preferably sufficiently buoyant so as to make the weight of the completed tail portion substantially equal to that of a body of water of the same volume, i.e., the tail portion including the detecting devices is neutrally buoyant. Also in accordance with the preferred embodiment of the present invention the distal end of the tail portion containing the detecting devices is provided with a configuration which introduces turbulence when under tow, the arrangement being such that a certain amount of drag is introduced which minimizes the tendency of the tail portion to snake.

The smoother towing characteristics obtained by the present invention also provide advantages when several "tails" are towed in parallel because they tend to remain parallel and the desired distance apart and thus the several signals picked up are more meaningful when compared with one another.

In employing electric field or magnetic field type detection gear for locating submerged metallic objects such as ground mines on a sea bottom it is usual to make use of a conductor cable provided with one or more detecting devices spaced along the trailing end of the cable the leading end of which is connected to a surface vessel carrying the required instrumentation for receiving and/or recording any signals produced by the detecting devices. In operation the surface craft streams the cable so that it drags along the submerged surface of the body of water, the forward movement being substantially constant so that when a metallic object within detecting range is passed the detecting devices produce a characteristic signal which can be interpreted and/or recorded aboard the towing vessel.

The cable conductor of the present invention is functionally indifferent to the particular form the detecting devices may take since the primary use of the improved cable construction is to assure that its passage along the submerged surface is rendered as smooth as possible. Induction type detecting devices for example are well known and generally include one or more coils brought into electrical balance and thrown off electrical balance if a ferrous or non ferrous metal object comes close to it. Acoustic and galvanic type detecting devices are also known.

A feature of the cable of the present invention involves a structure which tends when towed at a substantially constant speed to glide along the submerged surface with a continuous uniform motion and any deviations or departures from a straight path such as are caused by irregularities in or obstructions on the submerged surface are neither sudden nor abrupt so that a substantial reduction in the amount of background noise is obtained. Therefore, a further object of the present invention is to avoid or at least substantially reduce the amount of background noise present in field detection gear when under tow.

Figure 2:
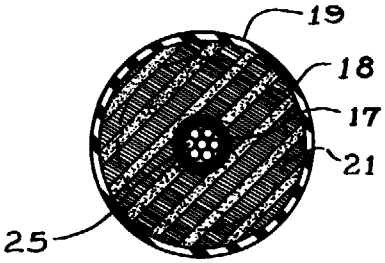

Other objects and advantages of the invention will be evident from the following discription when read in connection with the accompanying drawing in which:

FIG. 1 illustrates partly in section the preferred embodiment of the cable of the invention being towed by a surface vessel; and FIG. 2 is a cross sectional view taken on line 2—2 of FIG. 1.

As shown in the drawing a detecting tail portion 10 is being dragged by a towing vessel 11 along a surface 12 submerged under a body of water 13 through a suitable towing and conductor cable 14. The towing cable 14 may be of a conventional type comprising at least one electrical conductor and usually a plurality of electrical conductors 25 suitably insulated from each other and from the surrounding water 13. At the forward end of the detecting tail portion 10 a suitable weight 15 is secured to the cable 14 as by a cable stocking 16. The weight 15 preferably surrounds the cable 14, has a diameter substantially equal to the diameter of the tail portion 10 and is of sufficient density to maintain it on the submerged surface 12 while being towed at the contemplated towing speed. As will appear hereinafter the tail portion 10 is preferably of neutral buoyancy so that it streams behind the weight 15 to provide increased stability or smoothness of movement along the surface 12.

The tail portion 10 is constructed to have a uniform diameter along its length and comprises a conductor cable 17 (which preferably is an extension of the cable 14) having individual electrical conductors 25 and surrounded with a suitable lightweight material 18 such as foam rubber or styrofoam and enclosed in an outer skin or casing 19 of wear resistant flexible material such as known rubber compositions. Suitable detecting devices 21 are mounted in spaced relation along and in electrical communication with the conductors 25 in the cable 17. It is to be understood that the layer of buoyant material 18 is at least thick enough to equal the diameter of detecting devices 21 and may be made thicker than this and also cover the detecting devices 21 if required to render the composite tail portion 10 neutrally buoyant in the water body 13 as is preferred.

The device as above described provides a structure having improved towing characteristics which may be and preferably are enhanced by forming the distal end of the tail portion 10 so that it purposely offers more resistance to movement through the water and thereby reduces any tendency to snake. As here shown the desired increase in resistance is obtained by connecting to the tail portion 10 a plurality of spaced cylindrical segments 22 with forwardly tapered cone-shaped sections 23. The configuration provided by the segments 22 and the sections 23 when pulled through the water induces turbulence as indicated at 24 to provide the desired amount of drag, it being understood that the segments 22 have substantially the same diameter as the rest of the tail portion 10 and that these segments in combination with the sections 23 preferably have substantially zero buoyance.

While for the purpose of disclosing the invention a preferred embodiment thereof has alone been described in detail it will be evident to those skilled in the art that various modifications will readily suggest themselves without departing from the scope of the invention as set forth in the appended claims.

What is claimed is:

1. A towable detecting gear adapted for dragging over a water-submerged surface comprising a tail portion, a towing cable having its trailing end enclosed in the tail portion and having at least one insulated conductor, a weight member secured to said cable at the forward end of the tail portion and having sufficient negative buoyancy to drag along said submerged surface when under tow, a plurality of detecting devices disposed at intervals along the cable in said tail portion and in electrical communication with a conductor therein, said detecting devices being substantially larger in cross section than the diameter of said cable, a layer of buoyant material surrounding said cable between said devices and having a thickness such that its diameter is at least equal to the diameter of said detecting devices, and an outer covering of wear resistant flexible material enclosing said tail portion.

2. The detecting gear of claim 1 in which the weight of said tail portion is substantially equal to that of a body of water of the same volume.

3. The detecting gear of claim 2 in which the distal end of said tail portion is provided with a configuration which induces turbulence when under tow.

4. A towable influence detecting gear adapted to be dragged along a water-submerged surface by a suitable towing line, said gear comprising at least one detecting device enclosed in an elongated cylindrical structure so constructed that it has neutral buoyance in water, a weight member having substantially the same diameter as said cylindrical structure connected to one end of said structure and adapted to be connected to a towing line, and means at the other end of said structure for resisting movement through water, said last mentioned means being substantially neutrally buoyant.

* * * * *